United States Patent [19]

Maisonneuve

[11] Patent Number: 4,464,126

[45] Date of Patent: Aug. 7, 1984

[54] FINBOARD EXERCISING APPARATUS

[76] Inventor: Leo Maisonneuve, 4480 40th St., N., Apt. 1, St. Petersburg, Fla. 33714

[21] Appl. No.: 472,854

[22] Filed: Mar. 7, 1983

[51] Int. Cl.[3] ..... B63H 16/12

[52] U.S. Cl. ..... 440/15; 440/32

[58] Field of Search ..... 416/79, 82, 84, 85; 441/65; 114/363; 272/93, 99, 72; 440/13–15, 21, 25, 32, 17, 19, 20

[56] References Cited

U.S. PATENT DOCUMENTS 3,361,106 1/1968 Hildebrand ..... 440/15

FOREIGN PATENT DOCUMENTS 959894 6/1964 United Kingdom ..... 440/14

*Primary Examiner*—Sherman D. Basinger

*Attorney, Agent, or Firm*—Walter J. Monacelli

[57] ABSTRACT

The exercising apparatus described herein is an exercising board having a maneuverable fin which may be used to propel the board by its upward and downward motion. The board is used on water and may be used in surf riding. The rider stands on the board and moves a vertical handle backward and forward. The lower end of this handle is angled in such a manner that a fin attached at the lower end moves a flexible fin upward and downward in a manner similar to a fish's fin and provides a propelling force. The force required to move this handle and the attached fin provides a very beneficial exercise to the arms, legs and body.

3 Claims, 6 Drawing Figures

FIG. 1
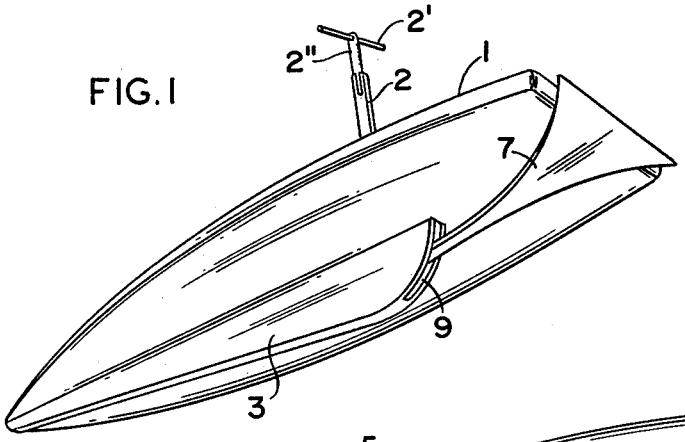
FIG. 2
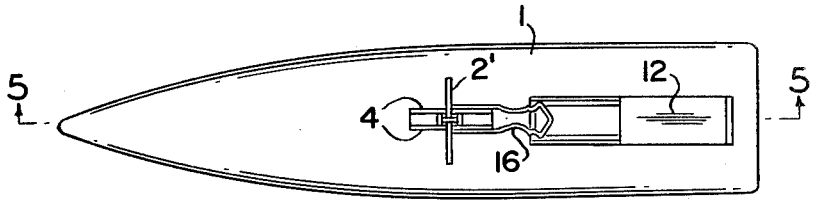
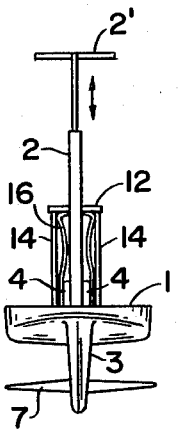
FIG. 3
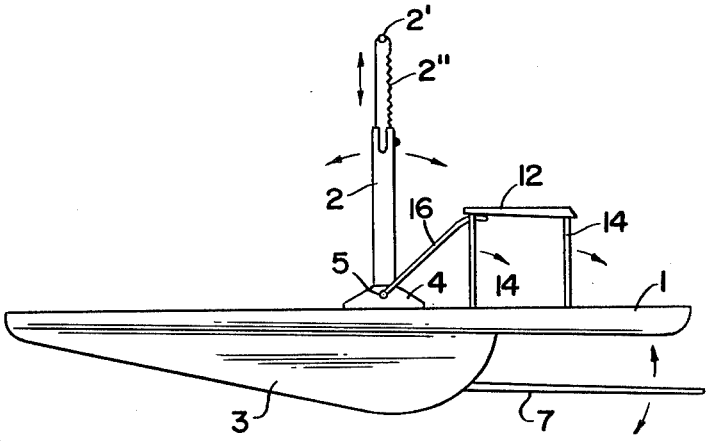
FIG. 4
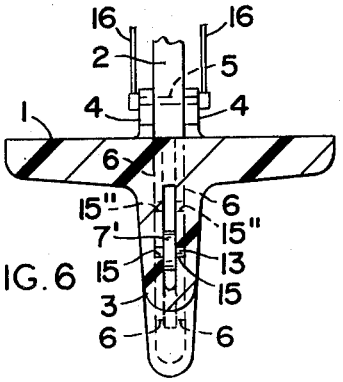
FIG. 6
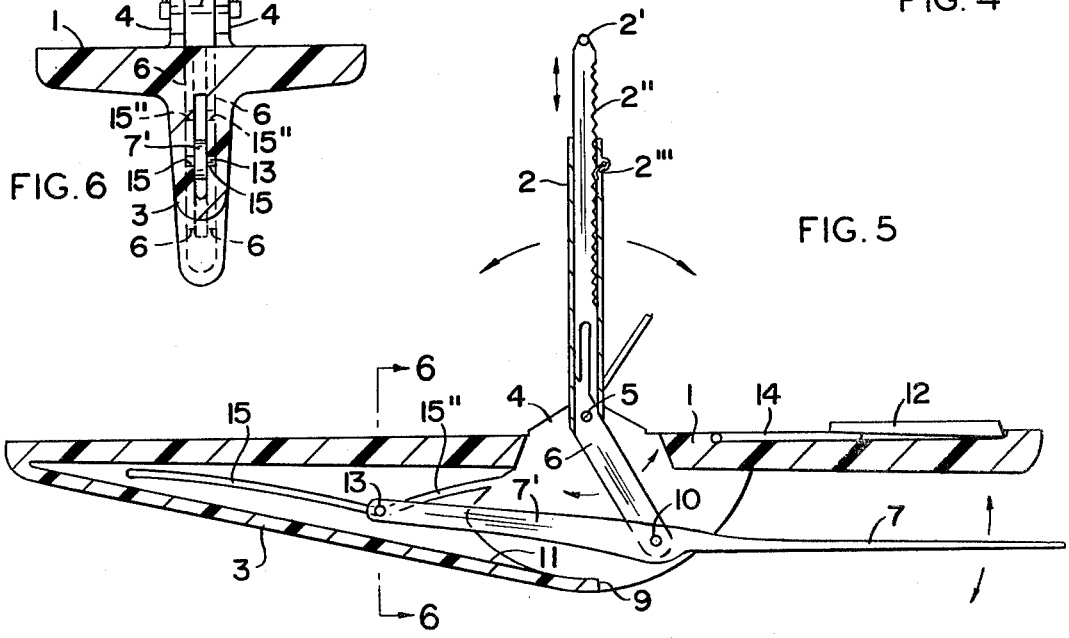
FIG. 5

FINBOARD EXERCISING APPARATUS

BACKGROUND OF THE INVENTION

1. Field of the Invention

This invention relates to exercising apparatus. More specifically, it relates to a large board adapted for use as a surfboard equipped with a fin below the board and a vertical lever arm extending above and below the board and adapted to move one end of the fin upward and downward.

2. State of the Prior Art

A number of patents disclose propelling devices attached to boats, which devices are actuated by a lever arm extending upward from the bottom of the boat. However, none of these patents disclose the use of fins which have one end of the fin actuated in upward and downward motions. Such patents include U.S. Pat. Nos. 923,283, 1,677,847, 3,369,517 and 4,214,547.

U.S. Pat. No. 3,256,850 discloses a "watercraft" propulsion means. The watercraft resembles a surf board but the propulsion means is a hinged device attached to the rear of the watercraft. The hinged arrangement allows this means to fold upon downward movement in the water and to flatten out upon upward movement so as to provide the propelling force. There are no fins disclosed in this reference.

SUMMARY OF THE INVENTIONJ

In accordance with the present invention, an exercise device has been designed which comprises a board of appropriate length to be used as a surfboard, that is having a length substantially greater than its width, a lever arm extending vertically upward from the upper surface of the board and pivotally attached to the board at its lower end, a lower arm rigidly attached to said lever arm at an angle pointing toward the rear of the board, said lever arm projecting through an opening in the board to a region below the board, a fin having a first pivotal attachment at its forward end with its rear end free to move upward and downward, said fin having a second pivotal attachment, said second pivotal attachment being to the lower end of said lower arm in such a manner that said fin is adapted to have its rear end move upward and downward in accordance with forward and backward movement of the top end of said lever arm, and a keel-like structure (mechanical housing) extending vertically downward under the boat from a point in the forward region of the board to a point to the rear of the opening through which said lower arm is projected, said housing having an opening into which said lower arm and shaft of said fin are free to move upward and downward and backward and forward.

The novel design of this invention may be illustrated by reference to the accompanying drawings in which:

FIG. 1 is a perspective view of a preferred modification of the apparatus of this invention taken from a point below and to one side of the apparatus;

FIG. 2 is a top view of the modification shown in FIG. 1;

FIG. 3 is a front view of the same modification;

FIG. 4 is a side elevational view of the same modification;

FIG. 5 is a cross-sectional view taken at line 5—5 of FIG. 2; and

FIG. 6 is a cross-sectional view taken at line 6—6 of FIG. 5.

In FIGS. 1-6, board 1 has lever arm 2 extending upward therefrom and mechanism housing 3 extending downward from the underside of the board. Lever arm 2 with cross arm 2′ is attached to a projection portion 4 of the board 1 by pivot connection 5 and is rigidly attached to lower arm 6 which projects downward at an angle from the lever arm 2. The upper part of arm 2 is a rod 2″ having horizontal grooves or slots on one side so that spring 2‴, which extends through the lower sleeve portion of arm 2, will engage and hold rod 2″ in position. When spring 2‴ is pulled outward, rod 2″ may be raised or lowered inside the sleeve portion. Lower arm 6 extends through an opening (not shown) in board 1 to the region under the board where it is pivotally attached to finshaft 7′ by pivotal connection 10. The inside of mechanism housing 3 is hollow with bottom 11 as shown by the cross-sectional view given in FIG. 5 in which the lower portion of lower arm 6 and the forward portion of fin 7 are shown. These are otherwise hidden by the sidewall of housing 3. The forward part of finshaft 7′ has a pin 13 extending horizontally and perpendicularly therethrough which travels along grooves (or cams) 15 and 15″ which grooves are formed or cut into the sidewalls of the mechanism housing. As arm 6 moves forward and downward, this pin travels forward in groove 15 and as arm 6 moves backward and upward pin 13 moves in groove 15′. This pin acts as a pivot for fin 7. Retractable seat 12 is shown in raised position in FIG. 4 and in retracted or folded position in FIGS. 2 and 5. Legs 14 support the seat when in the raised position and locking device 16 holds the seat in position by locking behind forward legs 14.

The manner of operation will be best understood by reference to FIGS. 2 and 5. When lever arm 2 is moved backward (that is, to the right in this view), lower arm 6 is also moved so that pivot connection 10 is moved to a lower position thereby moving the free end of fin 7 to a lower position. Then, when lever arm 2 is returned to its original vertical position and beyond to a forward position, the said free end of fin 7 is moved upward. This downward and upward movement of flexible fin 7 effects a propelling force which moves board 1 forward on the surface of the water on which it floats in the manner of a surfboard. When it is desired to turn the board to the left or right, the rider may do this by shifting his weight to his left foot or right foot respectively, as on a surfboard.

When the rider is standing on the board, this manner of propelling the board provides exercise for the arms, legs and middle body portion of the rider.

The fin is advantageously made of a flexible material such as rubber of the type used in swimmer's or diver's fins, or fiberglass, or a combination of both. The board housing and lever arms may be made of wood or other floatable material having appropriate strength such as plastics with or without fiberglass reinforcement, etc. If desired, the board may be made of reinforced foam polystyrene with special reinforcement in the area where the pivotal connection with the lever arm is made. Metal may be used for the lever arm and lower arm, preferably of lightweight metal and coated for protection against corrosion.

The size of the board, lever arms and fin may be varied to accommodate the desires and size of the rider. For example, the lever arm may be of a length to extend 3-5 feet above the board and may be telescoped. The board may be of various appropriate lengths and widths with various appropriate adjustments in the size of the accessories. The pivotal connections may be wrist pins or other appropriate device with provisions made to avoid having the pins fall out of position.

The housing is rigidly attached to the bottom of the board or hull in a manner resembling an ordinary keel except that the housing has a slot 9 and hollow portion to house the finshaft portion 7' and the lower arm 6.

Although separate reference is made to lever arm 2 and lower arm 6, these may comprise the lever arm as a single element with the lower portion bent at the appropriate angle, advantageously about 20° to 45°, preferably about 30°.

The housing described above is positioned under the board and under the lower arm 6 in such a manner that the linear axis of the housing is positioned directly under the linear axis of the board and in such a manner that the lower arm 6 and the finshaft are housed in the housing hollow in such a manner as to provide space for the movements described above.

Moreover, as shown in the drawings, the fin is preferably shaped to have a wide portion at the free end and the opposite end narrowed to where it is attached to the finshaft. The finshaft has the two pivotal connections to the lower arm and the sidewalls of the housing opening or slot as described above.

While certain features of this invention have been described in detail with respect to various embodiments thereof, it will of course be apparent that other modifications can be made within the spirit and scope of this invention, and it is not intended to limit the invention to the exact details insofar as they are defined in the following claims.

The invention claimed is:

1. An exercise apparatus comprising:

(a) a floatable board having an opening approximately in the center thereof extending through from the top surface to the bottom surface;

(b) a lever arm positioned over said opening extending vertically over said board and pivotally attached at or near the lower end thereof to said board;

(c) a lower arm extending downward through said opening, rigidly attached to the lower end of said lever arm and angled somewhat toward the rear of the board;

(d) a housing having sidewalls rigidly fastened to the underside of said board, positioned parallel to the linear axis of said board and having a hollow portion between said sidewalls therein positioned under said opening so as to accommodate the lower end of said lower arm, said sidewalls each having a groove extending from the inside of said housing a substantial depth into the thickness of said sidewall and running from the forward part of said sidewall through a substantial part of the length of said sidewall and then turning at an upward angle;

(e) a flexible fin having one end wider than the other; and (f) a finshaft rigidly attached to the narrower end of said fin, pivotally attached to the lower end of said lower arm and also having a pin extending perpendicularly and horizontally through said finshaft near the forward end of said finshaft, said pin being of sufficient length to reach into said grooves in said housing sidewalls and adapted to move forward and backward in said grooves as said finshaft moves forward and backward, the hollow portion of said housing being of appropriate size and shape to accommodate movement of said lower arm and said finshaft whereby forward and backward movement of said lever arm effects an upward and downward movement respectively of the wider end of said fin.

2. The apparatus of claim 1 in which said lever arm and said lower arm comprise a single element having an appropriate angular portion at the lower end thereof.

3. The apparatus of claim 1 in which a collapsible seat is positioned between said lever arm and the rear end of said board, said seat being adapated to being fixed in a raised positin for the rider's sitting purpose and to being collapsed and lowered by release of the fixing means.

* * * * *